US010273777B2

(12) United States Patent
Conzemius et al.

(10) Patent No.: US 10,273,777 B2
(45) Date of Patent: Apr. 30, 2019

(54) TELEMETRICALLY OPERABLE PACKERS

(71) Applicant: Halliburton Energy Services, Inc, Houston, TX (US)

(72) Inventors: Eric Conzemius, The Colony, TX (US); Megan Rae Kelley, Carollton, TX (US); Reid Elliott Zevenbergen, Frisco, TX (US); Gregory Thomas Werkheiser, Dallas, TX (US)

(73) Assignee: Halliburton Energy Services, Inc, Houston, TX (US)

( * ) Notice: Subject to any disclaimer, the term of this patent is extended or adjusted under 35 U.S.C. 154(b) by 0 days.

(21) Appl. No.: 15/506,345

(22) PCT Filed: Oct. 15, 2014

(86) PCT No.: PCT/US2014/060729

§ 371 (c)(1),
(2) Date: Feb. 24, 2017

(87) PCT Pub. No.: WO2016/060659

PCT Pub. Date: Apr. 21, 2016

(65) Prior Publication Data

US 2017/0275962 A1 Sep. 28, 2017

(51) Int. Cl.

| | |
|---|---|
| ***E21B 33/128*** | (2006.01) |
| ***E21B 47/14*** | (2006.01) |
| ***E21B 47/12*** | (2012.01) |
| ***E21B 34/06*** | (2006.01) |
| ***E21B 33/129*** | (2006.01) |

(Continued)

(52) U.S. Cl.
CPC ..... *E21B 33/128* (2013.01); *E21B 23/06* (2013.01); *E21B 33/1272* (2013.01); *E21B 33/1275* (2013.01); *E21B 33/1285* (2013.01); *E21B 33/1291* (2013.01); *E21B 33/1293* (2013.01); *E21B 34/066* (2013.01); *E21B 47/122* (2013.01); *E21B 47/14* (2013.01)

(58) Field of Classification Search
CPC ..... E21B 33/128; E21B 33/1285; E21B 23/06
See application file for complete search history.

(56) References Cited

U.S. PATENT DOCUMENTS 3,189,095 A * 6/1965 De Rochemont ... E21B 33/1295 166/120
4,367,794 A 1/1983 Bednar et al.
(Continued)

OTHER PUBLICATIONS

International Search Report and the Written Opinion of the International Search Authority, or the Declaration, dated Jul. 14, 2015, PCT/US2014/060729, 12 pages, ISA/KR.

*Primary Examiner* — Giovanna C Wright
*Assistant Examiner* — Jonathan Malikasim
(74) *Attorney, Agent, or Firm* — Haynes & Boone, LLP

(57) ABSTRACT

A down-hole packer is provided for positioning in a wellbore to establish a seal with a surrounding surface. The packer includes a sealing element that is responsive to compression by a setting piston to radially expand into the wellbore. An actuator is provided to longitudinally move the setting piston in response to a telemetry signal received by the down-hole packer. The actuator can include a hydraulic pump, an electromechanical motor or valves operable to control hydraulic energy to apply a down-hole force to the setting piston.

23 Claims, 8 Drawing Sheets

(51) Int. Cl.
*E21B 23/06* (2006.01)
*E21B 33/127* (2006.01)

(56) References Cited

U.S. PATENT DOCUMENTS

| | | | | |
|---|---|---|---|---|
| 4,576,233 | A * | 3/1986 | George | E21B 34/06 166/297 |
| 4,791,992 | A | 12/1988 | Greenlee et al. | |
| 5,058,673 | A * | 10/1991 | Muller | E21B 33/124 166/187 |
| 5,375,662 | A | 12/1994 | Echols, III et al. | |
| 5,558,153 | A | 9/1996 | Holcombe et al. | |
| 6,547,011 | B2 * | 4/2003 | Kilgore | E21B 33/1246 166/187 |
| 6,684,953 | B2 | 2/2004 | Sonnier | |
| 7,397,388 | B2 * | 7/2008 | Huang | E21B 47/182 166/373 |
| 8,220,533 | B2 | 7/2012 | Longfield et al. | |
| 8,258,975 | B2 | 9/2012 | Tinnnen et al. | |
| 8,616,276 | B2 | 12/2013 | Tips et al. | |
| 2001/0018977 | A1 | 9/2001 | Kilgore | |
| 2003/0192692 | A1 | 10/2003 | Tubel | |
| 2012/0067594 | A1 | 3/2012 | Noske et al. | |
| 2014/0216764 | A1 | 8/2014 | Derby | |

* cited by examiner

TELEMETRICALLY OPERABLE PACKERS

PRIORITY

The present application is a U.S. National Stage patent application of International Patent Application No. PCT/US2014/060729, filed on Oct. 15, 2014, the benefit of which is claimed and the disclosure of which is incorporated herein by reference in its entirety.

BACKGROUND

1. Field of the Invention

The present disclosure relates generally to systems, tools and associated methods utilized in conjunction with hydrocarbon recovery wells. More particularly, embodiments of the disclosure relate to apparatuses and methods for setting well annulus packers.

2. Background Art

In the hydrocarbon production industry, packers are used for testing, treating and various other sealing and partitioning operations in a wellbore. A packer is often coupled to an outer surface of a mandrel, e.g., a string of production tubing or other work string, and run into the wellbore in a radially contracted state. Once the packer arrives at its intended destination in the wellbore, an elastomeric sealing element of the packer can be radially expanded to establish a seal with a surrounding surface, e.g., casing pipe or a geologic formation, thereby setting the packer in the annulus between the mandrel and the surrounding surface.

Annular packers can be set by a variety of methods. Some of these methods include exerting a mechanical force (a setting force) on the sealing element to longitudinally compress the sealing element, and thereby cause the sealing element to laterally swell into the annulus. The setting force can be exerted on the sealing element by mechanically applying a down-hole force from a surface location, e.g., by manipulating a service tool or work string. Alternatively, the sealing element can be selectively actuated by opening a valve or bursting a rupture disk to thereby permit hydraulic energy to be transferred from fluids present in the wellbore to the sealing element. Often these valves must be opened by mechanical intervention, by dropping a ball or dart, etc. from the surface, and these rupture disks are often activated by the application of pressure from the surface. Additional tubing runs and extra equipment can make these methods costly and time consuming. Since packers are often required to be set, unset, and reset multiple times, the use of telemetrically operable packers can significantly reduce the amount of intervention required, thereby reducing the cost and complexity of many wellbore operations.

BRIEF DESCRIPTION OF THE DRAWINGS

The disclosure is described in detail hereinafter on the basis of embodiments represented in the accompanying figures, in which.

DETAILED DESCRIPTION

Figure 1:
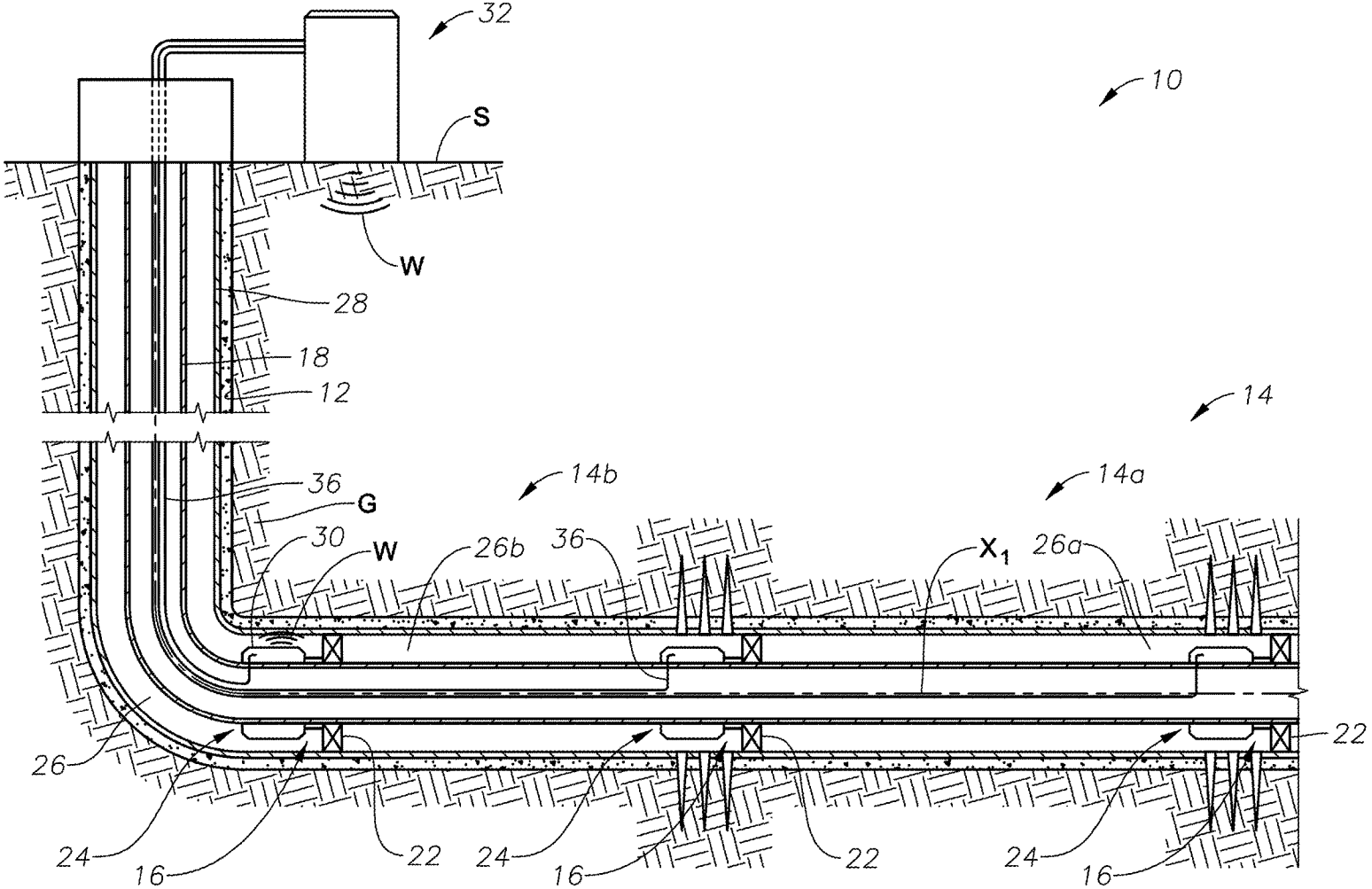
FIG. 1 is a partially cross-sectional schematic view of a well system including a plurality of telemetrically operable packers having setting mechanisms in telemetric communication with a surface location in accordance with example embodiments of the present disclosure.

In the interest of clarity, not all features of an actual implementation or method are described in this specification. Also, the "exemplary" embodiments described herein refer to examples of the present invention. In the development of any such actual embodiment, numerous implementation-specific decisions may be made to achieve specific goals, which may vary from one implementation to another. Such would nevertheless be a routine undertaking for those of ordinary skill in the art having the benefit of this disclosure. Further aspects and advantages of the various embodiments and related methods of the invention will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "below," "lower," "above," "upper," "uphole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 illustrates a well system 10 in accordance with example embodiments of the present disclosure. In well system 10, a wellbore 12 extends through a geologic formation "G" along a longitudinal axis "$X_1$." A plurality of zones 14 (designated as zones 14*a* and 14*b*) are defined in the wellbore 12 by a plurality of packers 16 longitudinally spaced along a work string 18. In some example embodiments, the work string 18 can comprise a string of tubular members interconnected with one another (e.g., a production or injection tubing string). Although the portion of the wellbore 12 that intersects the zones 14 is depicted as being substantially horizontal, it should be understood that this orientation of the wellbore 12 is not essential to the principles of this disclosure. The portion of the wellbore 12 which intersects the zones 14 could be otherwise oriented (e.g., vertical, inclined, etc.).

The packers 16 each include a sealing element 22 and setting mechanism 24. The sealing elements 22 fluidly isolate the zones 14*a* and 14*b* from one another in the wellbore 12 and seal off an annulus 26 formed between the work string 18 and a casing 28, which lines the wellbore 12. However, if the portion of the wellbore 12 which intersects the zones 14 were uncased or open hole, then the packers 16 could seal between the work string 18 and the geologic formation "G." An annular space 26*a*, 26*b* is defined radially around the work string 18 and longitudinally between the sealing elements 22 for each respective zone 14*a*, 14*b*. With the packers 16 properly set in the annulus 26, various tests or treatments can be performed in one of the annular spaces 26*a* without contaminating or affecting the other annular space 26*b*.

The setting mechanism 24 of each packer 16 can operate to radially expand the respective sealing element 22 to set the packer 16 in the annulus 26. In some embodiments, the setting mechanisms 24 are provided at an up-hole location with respect to each respective sealing element 22. Other relative positions for the setting mechanism 24 are also contemplated such as down-hole of the respective sealing element, radially adjacent the respective sealing element and/or combinations thereof.

The setting mechanisms 24 can each be telemetrically coupled to a surface location "S" by a communication unit 30. The communication unit 30 can be communicatively coupled to a surface unit 32 by wireless systems such as acoustic and electromagnetic telemetry systems. Such systems generally include hydrophones or other types of transducers to selectively generate and receive waves "W," which are transmissible through the geologic formation "G" and/or a column of fluid in the wellbore 12. Both the communication unit 30 and the surface unit 32 can send and receive instructions, data and other information via the waves "W." In some embodiments, the communication units 30 can additionally or alternatively be communicatively coupled to the surface unit 32 by control lines 36, which extend through the wellbore 12 to the surface location "S." The control lines 36 can include hydraulic conduits, electrical wires, fiber optic waveguides or other signal transmission media as appreciated by those skilled in the art.

Figure 2:
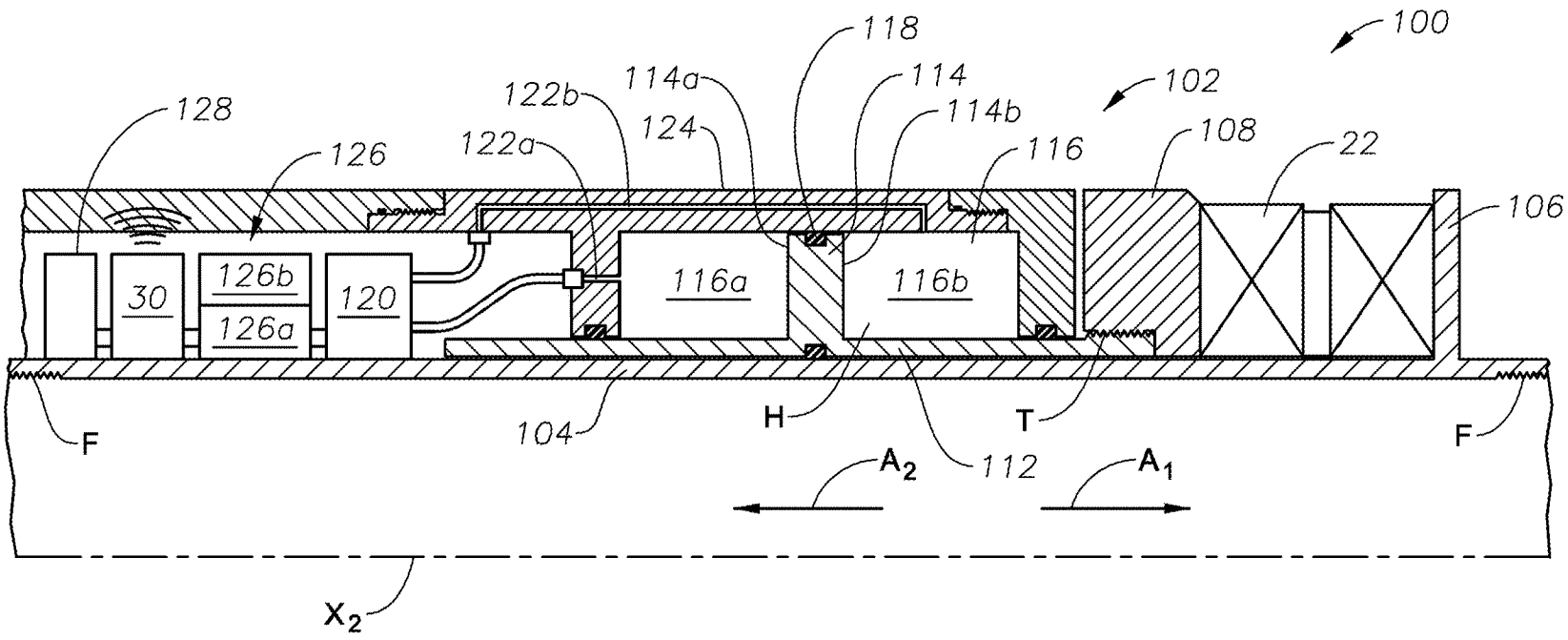
FIG. 2 is a cross-sectional schematic view of a packer having a hydraulic setting mechanism operable in the well system of FIG. 1 in accordance with example embodiments of the present disclosure.

Referring to FIG. 2, example embodiments a telemetrically operable packer 100 can include a hydraulically actuated setting mechanism 102 for radially expanding a sealing element 22, e.g., within the well system 10 of FIG. 1. Setting mechanism 102 includes a generally cylindrical mandrel 104 that defines a longitudinal axis "$X_2$." The mandrel 104 can be constructed of a generally rigid material such as steel, and can include fasteners "F" such as threads or other fasteners (not shown) disposed at longitudinal ends thereof to enable the mandrel 104 to be interconnected into a work string 18 (FIG. 1). The sealing element 22 is disposed radially about the mandrel 104, and can be constructed of rubber, a synthetic rubber, or another suitable deformable material. The sealing element 22 is disposed axially between an anchor 106 and a setting shoe 108. In some embodiments, the anchor 106 is formed integrally with the mandrel 104, or is otherwise axially fixed with respect to the mandrel 104. The setting shoe 108 is axially movable along the mandrel 104 in the directions of arrows $A_1$ and $A_2$ (toward and away from the anchor 106) to set and unset the sealing element 22. In some embodiments, both the anchor 106 and the setting shoe 108 are axially movable with respect to the sealing element 22 for setting and unsetting the sealing element 22.

A setting piston 112 is coupled to the setting shoe 108 by threads "T" or another mechanism such that axial motion is transferrable between the setting shoe 108 and the setting piston 112. The setting piston 112 includes a flange 114 extending into a fluid chamber 116. The flange 114 defines setting and unsetting faces 114*a* and 114*b* thereon. The setting piston 112 is responsive to operating pressures applied to the setting and unsetting faces 114*a* and 114*b* for reciprocal longitudinal movement with respect to the mandrel 104. For example, hydraulic pressure can be applied to the setting face 114*a* to move the setting piston 112 and the setting shoe 108 in a down-hole direction (arrow $A_1$), and hydraulic pressure can be applied to the unsetting face 114*b* to move the setting piston 112 and the setting shoe 108 in an up-hole direction (arrow $A_2$). The fluid chamber 116 is axially divided into two sub-chambers 116*a*, 116*b* by the flange 114, and the two sub-chambers 116*a*, 116*b* are fluidly isolated from one another by a seal 118 carried by the flange 114. Each sub-chamber 116*a*, 116*b* is fluidly coupled to an actuator such as pump 120 by a respective fluid passage 122*a*, 122*b* extending through a housing 124. The pump 120 is operable to selectively withdraw hydraulic fluid "H" from either sub-chamber 116*a* or 116*b*, and simultaneously provide hydraulic fluid to the other sub-chamber, 116*a* or 116*b*. The hydraulic fluid "H" imparts a force to the setting and unsetting faces 114*a*, 114*b* of the flange 114 to thereby move the setting piston 112 in both down-hole (arrow $A_1$) and up-hole (arrow $A_2$) longitudinal directions. Since the flange 114 can drive the setting piston 112 in two longitudinal directions, the setting piston 112 can be described as a "dual-action" piston.

The pump 120 can include, or be part of, small diameter pump systems such as down-hole ram-pump systems provided by WellDynamics, Inc., or down-hole hydraulic pump systems provided by Red Spider Technology, Ltd. These pump systems can be referred to as "micro-pumps" as the pump 120 can exhibit very small diameters, e.g., diameters about one half inch or less.

The pump 120 is operatively and communicatively coupled to a controller 126, such that the controller 126 can selectively instruct the pump 120 and receive feedback therefrom. In some embodiments, the controller 126 can comprise a computer including a processor 126*a* and a computer readable medium 126*b* operably coupled thereto. The computer readable medium 126*b* can include a non-volatile or non-transitory memory with data and instructions that are accessible to the processor 126*a* and executable thereby. In some example embodiments, the computer readable medium 126*b* is operable to be pre-programmed with a plurality of predetermined sequences of instructions for operating the pump 120, and/or other actuators to achieve various objectives. These instructions can also include initiation instructions for each predetermined sequence of instructions. For example, some of the predetermined sequences of instructions can initiated in response to receiving a predetermined "START" signal (such as "SET" or "UNSET" signals) from the surface unit 32. (FIG. 1), some of the predetermined sequences of instructions can be initiated in response to the passage of a predetermined amount of time from deployment, and some predetermined sequences of instructions can be initiated only if the processor 126*a* determines that a predetermined set of conditions have been met.

The controller 126 is communicatively coupled to communication unit 30, which as described above, is communicatively coupled to the surface location "S" (FIG. 1). The communication unit 30 can receive instructions from the surface location "S" and transmit these instructions to the controller 126. For example, the communication unit 30 can receive a unique "START" signal from an operator at the surface location, and transmit the "START" signal to the controller 126. Responsive to receiving the "START" signal, the controller 126 can execute one of the predetermined sequences of instructions for operating the pump 120 stored on the computer readable medium 126*b*. The communication unit 30 can also transmit a confirmation signal to indicate that the controller 126 has determined that the predetermined sequence of instructions has been completed, and/or an error signal in the event the controller 126 determines that the setting mechanism 100 is not functioning within a predetermined set of parameters.

A power source 128 is provided to supply energy for the operation of the pump 120, controller 126, and/or communication unit 30. In some embodiments, power source 128 comprises a local power source such as a battery that is self-contained within the setting mechanism 100 or a self-contained turbine operable to generate electricity responsive to the flow of wellbore fluids therethrough. In some embodiments, power source 128 comprises a connection with the surface location "S" (FIG. 1) e.g., an electric or hydraulic connection to the surface location through control lines 36.

Figure 3A:
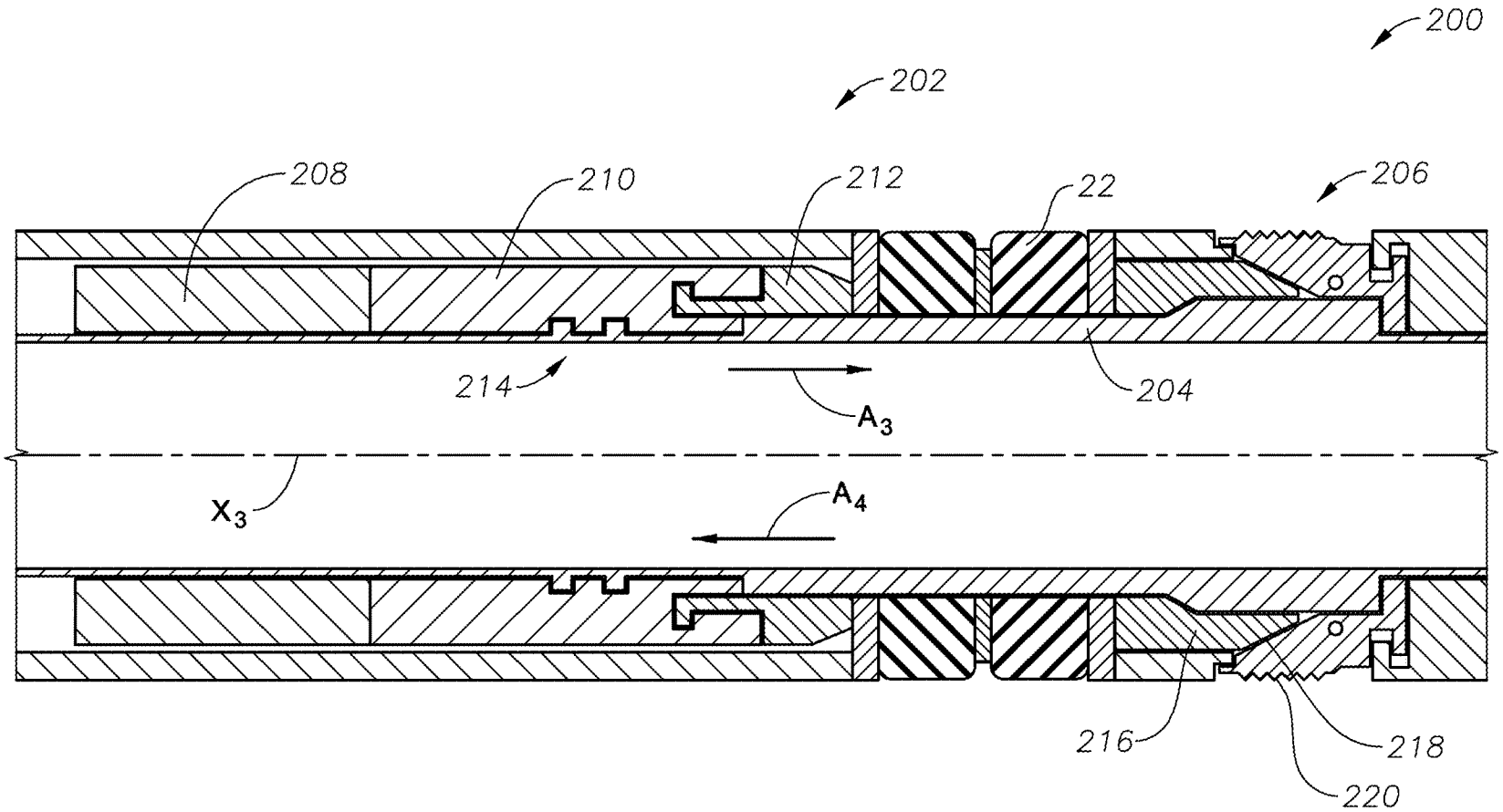
FIG. 3A is a cross-sectional schematic view of a packer having a packer slip and an electromechanical setting mechanism in accordance with example embodiments of the present disclosure.

Referring to FIG. 3A, example embodiments of a packer 200 include an electromechanical setting mechanism 202. Packer 200 includes a mandrel 204 defining a longitudinal axis "$X_3$." The setting mechanism 202, sealing element 22 and packer slips 206 are each disposed radially about the mandrel 204. The mandrel 204 can be constructed of a steel pipe or other substantially rigid member, and can include threads or other fasteners (not shown) at longitudinal ends thereof, which can facilitate interconnecting the packer 200 into a work string 18 (FIG. 1). The setting mechanism 202 generally includes a control module 208, drive module 210 and a setting piston 212 disposed radially about the mandrel 204.

The drive module 210 can be longitudinally anchored to the mandrel 204 by interconnecting ridges and grooves 214, and can be operable to bi-directionally move the setting piston 212 along a portion of the mandrel 204 in the directions of arrows $A_3$ and $A_4$. Since the drive module 210 is longitudinally anchored to the mandrel 204, an actuator (e.g., motor see FIG. 3B described below) of the drive module 210 can be maintained in a longitudinally stationary relation with the mandrel 204, and thus, a full force supplied by the actuator can be applied to the setting piston 212 to move the setting piston 212 longitudinally with respect to the mandrel 204. In some embodiments, the drive module 210 (and the actuator thereof) can be longitudinally anchored to the mandrel 204 by fasteners, welding or other recognized methods.

The drive module 210 can move the setting piston 212 in a first longitudinal direction (arrow $A_3$) along the mandrel 204 toward the sealing element 22. The setting piston 212 initially drives both the sealing element 22 and a cam wedge 216 in the first direction toward the packer slips 206. The cam wedge 216 and the packer slips 206 engage one another along inclined surfaces 218 such that the longitudinal motion of the cam wedge 216 in the first longitudinal direction (arrow $A_3$) drives the packer slips 206 radially outward until outer gripping surfaces 220 dig into the metal of casing 28 (FIG. 1). Once the outer gripping surfaces 220 of the packer slips 206 are engaged, the packer slips 206 impede further longitudinal movement of the cam wedge 216. Thus, further longitudinal movement of the setting piston 212 in the first direction longitudinally compresses the sealing element 22 between the setting piston 212 and the cam wedge 216. The sealing element 22 is thereby expanded radially from the mandrel to seal against the casing 28 (FIG. 1). Thus, the sealing element 22 can be set by movement of the setting piston 212 in the first longitudinal direction (arrow $A_3$).

The sealing element 22 can be unset by employing the drive module 210 to move the setting piston 212 in a second longitudinal direction (arrow $A_4$), and thereby move the setting piston 212 away from the sealing element 22. The sealing element 22 is then free to longitudinally relax and radially withdraw from the casing 28.

Figure 3B:
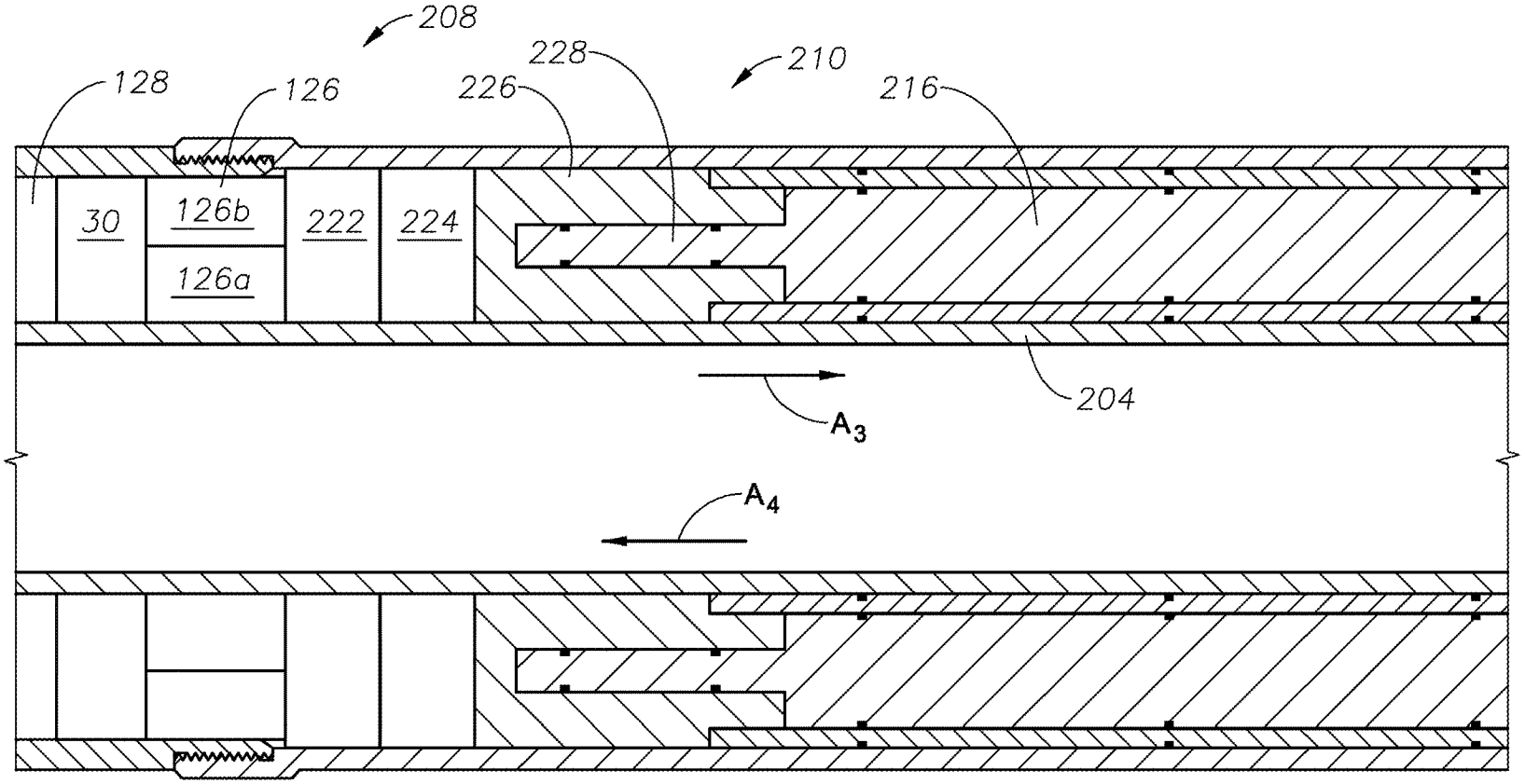
FIG. 3B is a cross-sectional schematic view of the electromechanical setting mechanism of FIG. 3A including a setting piston driven by an electromechanical actuator.

Referring to FIG. 3B, the drive module 210 can include an actuator such as a motor 222, which can be a rotary stepper motor, servo motor or other type of electric motor. The drive module can also include a gear box 224 and a transmission 226 that converts rotary motion from the motor 222 and gear box 224 and to linear motion. The transmission 226 can include a screw-drive, a rack and pinion mechanism or other rotary to linear mechanisms recognized in the art. A drive shaft 228 is operably coupled to the transmission 226 to axially move the setting piston 212 in the directions of arrows $A_3$ and $A_4$. In some example embodiments, the drive module 210 can include solenoids (not shown), linear induction motors (not shown), or other electrically operable linear actuators recognized in the art.

The control module 208 can include a power source 128, communication unit 30 and a controller 126. As described above, the controller 126 can comprise a computer including a processor 126*a* and a computer readable medium 1261) operably coupled thereto. The computer readable medium 126*b* can include instructions programmed thereon that are accessible to the processor 126*a* and executable thereby to operate the motor 222. The control module 208 generally enables an operator at the surface to selectively drive the setting piston 212 and thereby set and unset the sealing element 22 (FIG. 3A).

Figure 4B:
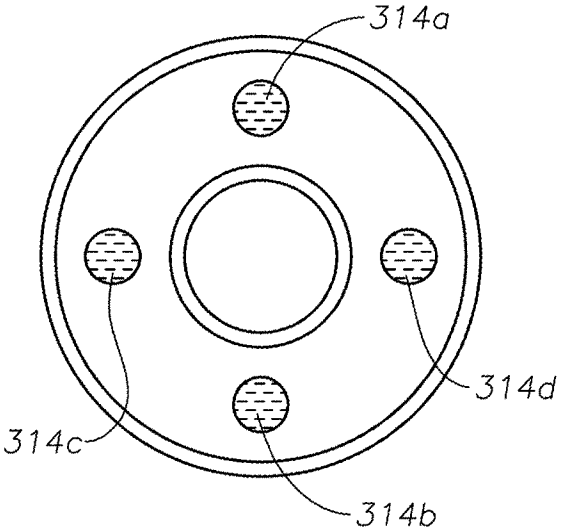
FIGS. 4A and 4B are cross-sectional schematic views of another electromechanical setting mechanism including a piston driven by a plurality of electromechanical actuators through a hydraulic reservoir.
Figure 4A:
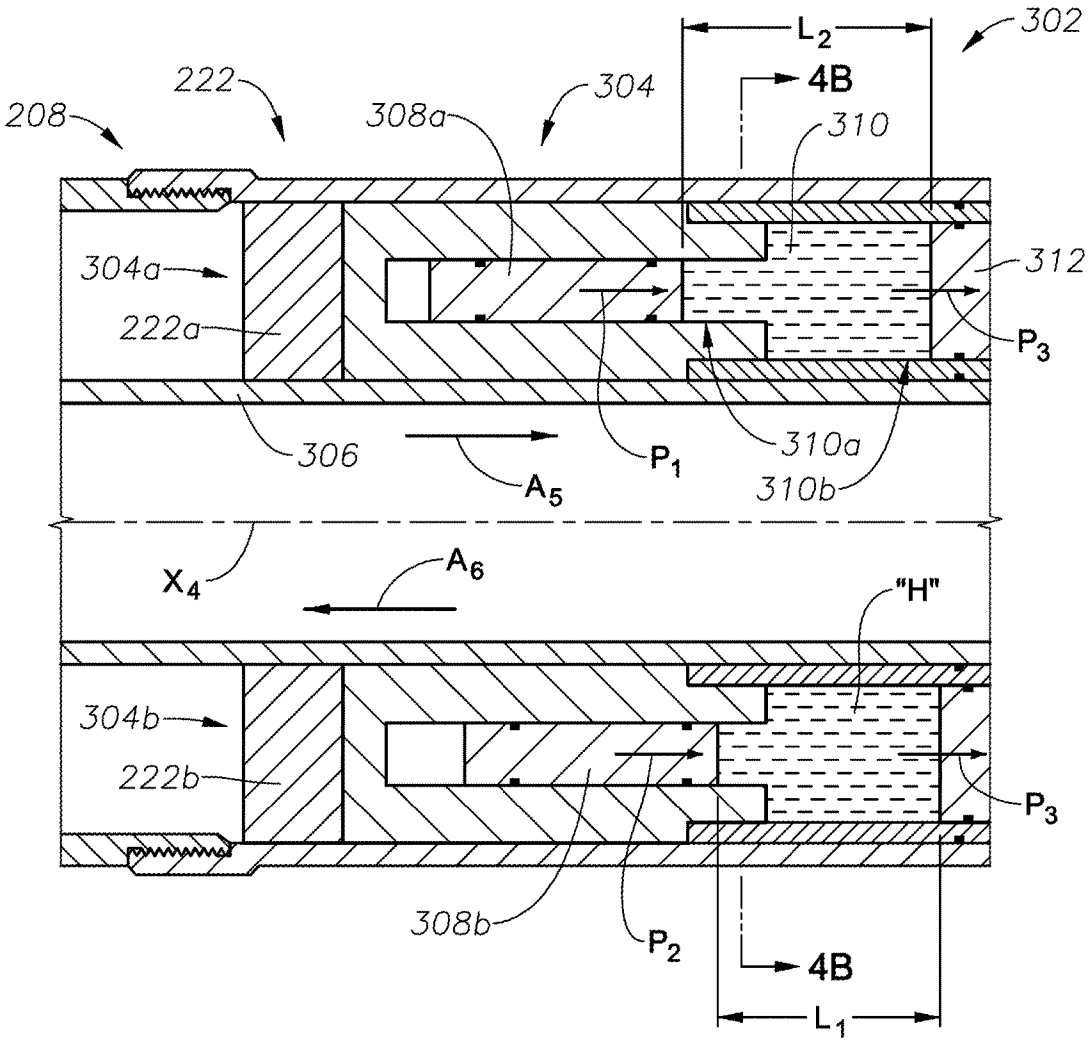

Referring now to FIGS. 4A and 4B, example embodiments of a setting mechanism 302 can include a plurality of individual actuators 304 (designated as 304*a* and 304*b*) disposed radially about a longitudinal axis "$X_4$." Each of the individual actuators 304 can comprise an individual electric motor 222 (designated as first and second electric motors 222*a* and 222*b*, respectively) that is longitudinally anchored to a mandrel 306. The first and second electric motors 222*a* and 222*b* are operably coupled to a control module 208 as described above. The setting mechanism 302 can also include a plurality of drive shafts 308 (designated as drive shafts 308*a* and 308*b*), an annular fluid reservoir 310 and a setting piston 312. As described in greater detail below, the individual actuators 304 are operable to move the setting piston 312 longitudinally along the mandrel 306 (in the directions of arrows $A_5$ and $A_6$).

The drive shafts 308*a* and 308*b* are operably coupled to the first and second electric motors 222*a* and 222*b* such that operation of the motors 222 moves the drive shafts 308*a*, 308*b* in longitudinal directions of arrows $A_5$ and $A_6$. In some embodiments, the drive shafts 308*a*, 308*b* are operably coupled to the first and second electric motors 222*a*, 222*b* through a gear box 224 (FIG. 3B) and transmission 226

(FIG. 3B) as described above. The first and second electric motors 222*a*, 222*b* are operable to generate first and second longitudinal forces, e.g., $P_1$ and $P_2$ respectively, which can be imparted to hydraulic fluid "H" through drive shafts 308*a*, 308*b*. The hydraulic fluid "H" is disposed within annular fluid reservoir 310 defined around the mandrel 306.

The longitudinal forces $P_1$ and $P_2$ are parallel forces applied between the mandrel 306 and the hydraulic fluid "H," which the hydraulic fluid "H" combines and distributes to impart a resultant longitudinal force $P_3$ to the setting piston 312. The hydraulic fluid "H" serves to balance or compensate for differences in the magnitude of longitudinal forces $P_1$, $P_2$. Thus, the drive shafts 308*a*, 308*b* can be operated in a misaligned configuration where each drive shaft 308*a*, 308*b* is disposed at a different longitudinal distance $L_1$, $L_2$ from the setting piston 312 without skewing the setting piston 312.

The fluid reservoir 310 includes a first section 310*a* in which the hydraulic fluid "H" is in contact with the drive shafts 308*a*, 308*b* and a second section 310*b* in which the hydraulic fluid "H" is in contact with the setting piston 312. As illustrated in FIG. 4B, the first section 310*a* includes a plurality of radially-spaced sub-chambers 314*a*, 314*b*. 314*c* and 314*d*, corresponding to each drive shaft 308*a*, 308*b*. Although four radially-spaced sub-chambers 314*a*, 314*b*. 314*c* and 314*d* are illustrated in FIG. 4B, it should be appreciated that more or fewer sub-chambers and corresponding drive shafts can be provided, A first cross-sectional area of the first section 310*a* (e.g., combined from each of the sub-chambers 314*a*, 314*b*. 314*c* and 314*d*) can be smaller than a second cross-sectional area of the second section 310*b*. Thus, a mechanical advantage can be realized from transmitting the forces $P_1$, $P_2$, through the hydraulic fluid to the setting piston 312. Those skilled in the art will recognize that the pressure of the hydraulic fluid "H" will be equal at every point within the fluid reservoir 310. Thus, the force $P_3$ imparted to the setting piston 312, which is distributed across a larger cross-sectional area, can be greater than the forces $P_1$, $P_2$ imparted from the drive shafts 308*a*, 308*b*, which are distributed across a smaller cross-sectional area.

Figure 5:
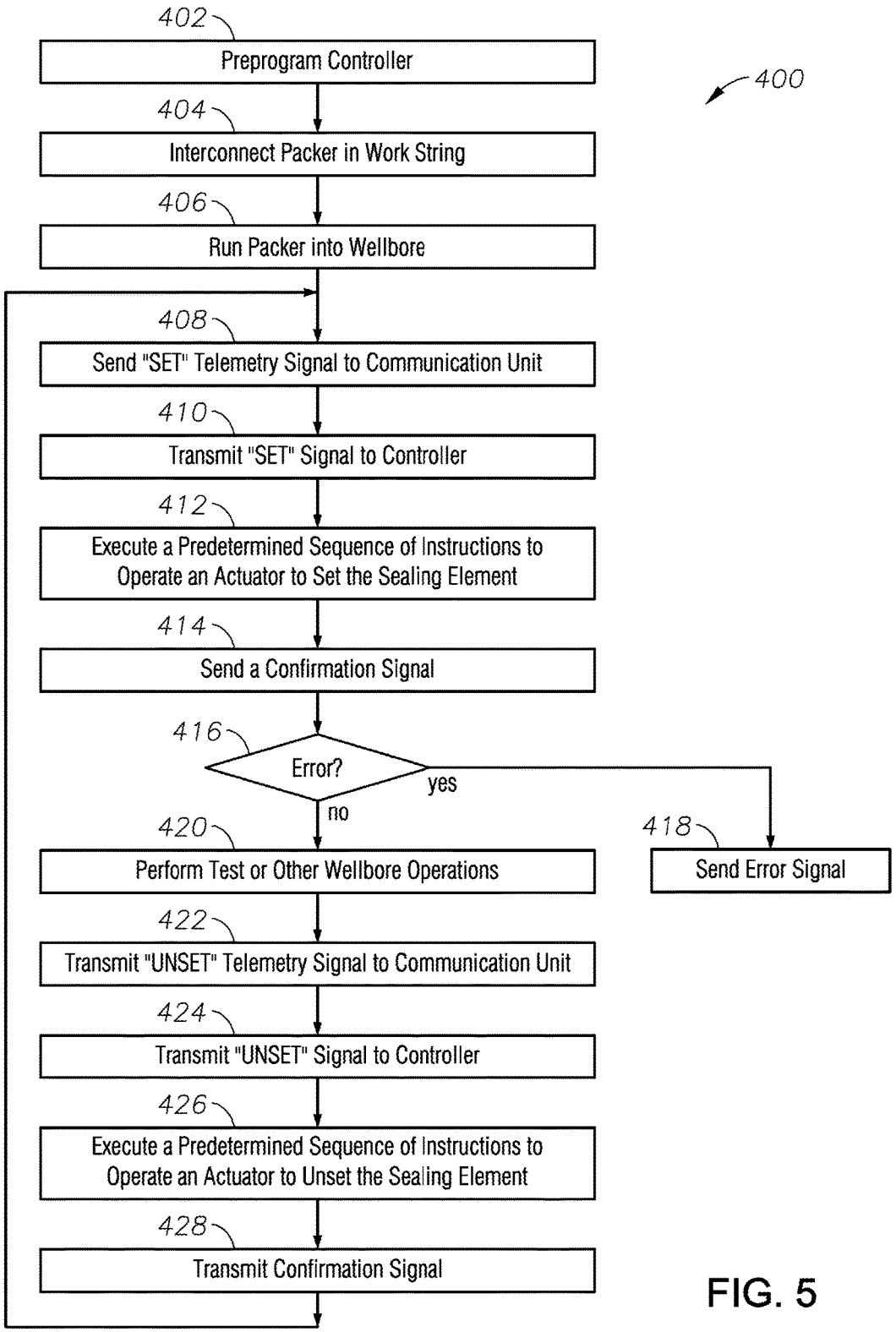
FIG. 5 is a flowchart illustrating a method of operating packers having the setting mechanisms of FIGS. 2, 3A and 4A in accordance with example embodiments of the present disclosure.

Referring to FIG. 5, an example operational procedure 400 that employs at least one of the setting mechanisms 102, 202 and 302 can be initiated by preprogramming the controller 126 at the surface location "S," e.g., by installing instructions and data onto the computer readable medium 126*b* (step 402). The mandrel 104, 204, 316 can be interconnected into a work string 18 (step 404), and the sealing element 22 and the setting mechanism 102, 202, 302 can be run into the wellbore 12 (step 406) on the work string 18. Once the sealing element 22 is in position, an operator can then send a "SET" telemetry signal from the surface unit 32 to the communication unit 30 of the setting mechanism 102, 202, 302 (step 408). The communication unit 30 can transmit the "START" signal to the processor 126*a* (step 410) to instruct the processor 126*a* to initiate an appropriate predetermined sequence of instructions stored on computer readable medium 126*b*. The processor 126*a* can execute the predetermined sequence of instructions to operate an actuator (step 412), e.g., the pump 120, motor 222 or motors 222.

When the pump 120 (FIG. 2) of setting mechanism 102 is employed in step 412, the pump 120 is operated to withdraw hydraulic fluid "H" from sub-chamber 116*b* and simultaneously provide hydraulic fluid "H" to sub-chamber 116*a*, thereby urging the setting piston 112 and setting shoe 108 toward the sealing element 22, e.g., in a compression direction. Movement of the setting piston 112 and setting shoe 108 in the compression direction causes the setting shoe 108 to compresses the sealing element 22 and thereby radially expand the sealing element 22 from the mandrel 104. As illustrated in FIG. 2, the compression direction is a down-hole direction (arrow $A_1$). In some example embodiments (not shown), the setting piston 112 and/or the setting shoe 108 can be arranged with respect to the sealing element 22 such that the compression direction can be an up-hole direction, a radial direction or other directions to compresses the sealing element 22 and thereby radially expand the sealing element 22 from the mandrel 104. As illustrated in FIG. 2, the sealing element 22 can be longitudinally compressed between the setting shoe 108 and the anchor 106, thereby causing the sealing element 22 to expand radially from the mandrel 104.

When the motor 222 (FIG. 3B) or motors 222*a*, 222*b* (FIG. 4B) of setting mechanisms 202 or 302 are employed in step 412, the motor or motors 222, 222*a*, 222*b* are operated to drive the drive shafts 228 or drive shafts 308*a*, 308*b* in a compression or down-hole direction. Movement of the drive shafts 228, 308*a* and 308*b* in the compression or down-hole direction urges the setting piston 212, 312 toward the sealing element 22 to longitudinally compress the sealing element 22, and thereby cause the sealing element 22 to radially expand into the annulus 26.

Once the processor 126*a* has executed the predetermined sequence of instructions, the processor 126*a* can send a confirmation signal to the surface location "S" via the communication unit 30 (step 414). In some embodiments, sensors or other feedback devices (not shown) can be queried by the processor 126*a* (decision 416) to verify proper setting of the sealing element 22, and when an error condition is identified, an error signal can be sent to the surface location "S" (step 418).

When no error condition is identified, a wellbore test or other operation can be performed in the wellbore 12 (step 420) as necessary with the sealing element 22 properly set. When the wellbore test or other operation is complete, the sealing element 22 can be unset by sending an "UNSET" telemetry signal from the surface unit 32 (step 422). The communication unit 30 can receive the "UNSET" signal and transmit "UNSET" signal to the controller 126 (step 424) to instruct the processor 126*a* to initiate another predetermined sequence of instructions. The processor 126*a* can execute the predetermined sequence of instructions (step 426) to operate the actuator to unset the sealing element 22.

For example the predetermined sequence of instructions can operate the pump 120 to withdraw hydraulic fluid "H" from sub-chamber 116*a* and simultaneously provide hydraulic fluid "H" to sub-chamber 116*b*, thereby urging the setting piston 112 and setting shoe 108 away from the sealing element 22, e.g., in an retracting direction. Movement of the setting piston 112 and the setting shoe 108 in the retracting direction permits the sealing element 22 to be relaxed, thereby causing the sealing element 22 to withdraw radially toward the mandrel 104. The retracting direction can be an up-hole direction. Alternately or additionally, the motor 222 (FIG. 3B) or motors 222*a*, 222*b* (FIG. 4B) can be operated to drive the drive shafts 228, 308*a*, 308*b* in the retracting or up-hole direction to permit the sealing element 22 to be longitudinally relaxed.

Once the processor 126*a* has executed the predetermined sequence of instructions for unsetting the sealing element 22, the processor 126*a* can again instruct the communication unit 30 to send a confirmation signal to the surface location "S" (step 428). The work string 18 can then be moved to another location in the wellbore 12, and sealing element 22 can be reset (return to step 408).

Figure 6:
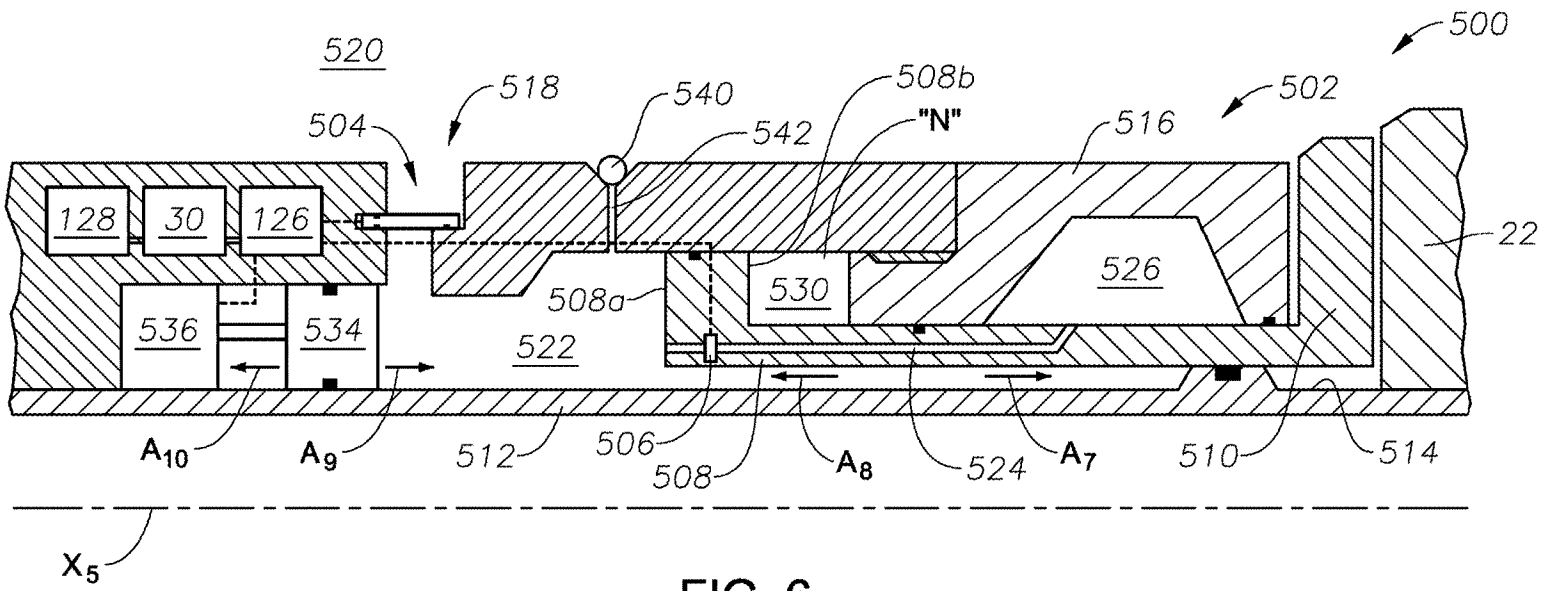
FIG. 6 is a cross-sectional schematic view of a packer having a setting mechanism that employs first and second piezoelectric valves and an electromechanical actuator for controlling the flow of hydraulic energy through the setting mechanism in accordance with example embodiments of the present disclosure.

Referring to FIG. 6, some example embodiments of a telemetrically operable packer 500 can include a setting mechanism 502 with first and second valves 504 and 506 therein. The first and second valves 504, 506 regulate fluid flow through the setting mechanism 502 to actuate a setting piston 508 and a setting shoe 510 defined at an end of the setting piston 508. The packer 500 includes a mandrel 512 defining a longitudinal axis $X_5$ and an exterior surface 514. Threads or other fasteners (not shown) can be provided on the mandrel 512 to facilitate interconnection of packer 500 into a work string 18 (FIG. 1). Sealing element 22 is disposed over a portion of the exterior surface 514 of the mandrel 512, and is responsive to compression, e.g., longitudinal compression, by the setting piston 508 to expand radially from the mandrel 512.

The setting mechanism 502 includes a housing 516 coupled to the mandrel 512. The first valve 504 is disposed within an entry port 518 extending through the housing 516 between an exterior environment 520 of the setting mechanism 502 and a piston chamber 522 defined within the setting mechanism 502. The exterior environment 520 can include, e.g., the annulus 26 (FIG. 1) when the packer 500 is run into the wellbore 12. In some embodiments (not shown) the exterior environment 520 can include an internal tubing passageway (not shown) defined radially within the mandrel 512. The piston chamber 522 encloses a setting face 508*a* of the setting piston 508 such that a fluid within the piston chamber 522 can impart a force to the setting face 508*a* to thereby move the setting piston 508 in a compression or down-hole direction (arrow $A_7$). The second valve 506 is disposed within a pass-through port 524 defined within the setting piston 508, and controls fluid flow between the piston chamber 522 and a dump chamber 526 defined within the housing 516. The dump chamber 526 is remotely disposed with respect to the setting and unsetting faces 508*a*, 508*b* of the setting piston. The first and second valves 504, 506 are both coupled to controller 126, communication unit 30 and power source 128, which together permit remote and/or telemetric operation of the first and second valves 504 and 506.

As described in greater detail below, first and second valves 504, 506 can be selectively opened and closed to drive the setting piston 508 in longitudinal directions, e.g., the directions of arrows $A_7$ and $A_8$. As the setting piston 508 is driven in the compression or a down-hole direction (in the direction of arrow $A_7$) a volume of the piston chamber 522 can increase, while simultaneously, a volume of a reset chamber 530 can decrease. The reset chamber 530 encloses the unsetting face 508*b* of the setting piston 508. In some example embodiments, the reset chamber 530 can be sealed or fluidly isolated within the housing 516, and can be charged or filled with a compressible fluid. In this regard, as shown in FIG. 6, the reset chamber 530 is fluidly isolated from both the piston chamber 522 and the dump chamber 526 within the housing 516. For example, the reset chamber 530 can be filled with a generally inert gaseous fluid such as argon or nitrogen "N," which facilitates prevention of unintended chemical reactions. The nitrogen "N" can impart a force to the unsetting face 508*b* to move the setting piston 508 in retracting or an up-hole direction (in the direction of arrow $A_8$), and thereby decrease the volume of the piston chamber 522.

In some example embodiments, a reset piston 534 can optionally be provided within the piston chamber 522. The reset piston 534 can be driven in the longitudinal directions of arrows $A_9$ and $A_{10}$ to thereby respectively decrease and increase the volume of the piston chamber 522. The reset piston 534 can be driven by a reset actuator 536 such as a motor, solenoid or hydraulic actuator, and in some example embodiments, can be controlled by controller 126 or another separate controller (not shown) operatively coupled to the communication unit 30. A check valve 540 can be provided in a passageway 542 extending between the piston chamber 522 and the exterior environment 520. The check valve 540 can prohibit fluid flow through the passageway 542 in a direction from the exterior environment 520 into the piston chamber 522, and permit fluid flow in an opposite direction, e.g., from the piston chamber 522 into the exterior environment 520. Thus, fluid can be expelled from the piston chamber 522, e.g., by activation of the reset piston 534 to decrease the volume of the piston chamber 522. In some embodiments, a biasing member (not shown) such as a spring or other mechanism can provided to maintain the check valve 540 in a closed position when a pressure in the piston chamber 522 is below a predetermined threshold pressure.

In some example embodiments, telemetrically operable valves (not shown) can alternately or additionally be disposed within the passageway 542, for selectively permitting fluid to be expelled from the piston chamber 522 into the exterior environment 520. In some example embodiments, fluid can be expelled from the piton chamber 522 into the dump chamber 526 by activation of the piston 534.

The piston chamber 522 defines a maximum volume when the reset piston 534 is moved as far as possible in retracting or the up-hole direction of arrow $A_{10}$ and the setting piston 508 is moved as far as possible in the in the compression or down-hole direction of arrow $A_7$. In some embodiments, the dump chamber 526 exhibits a volume that is at least twice the maximum volume of the piston chamber 522, and can exhibit a volume that is multiple times the maximum volume of the piston chamber 522. The relatively large volume exhibited by the dump chamber 526 facilitates repeatedly evacuating the piston chamber 522 as described in greater detail below.

Figure 7B:
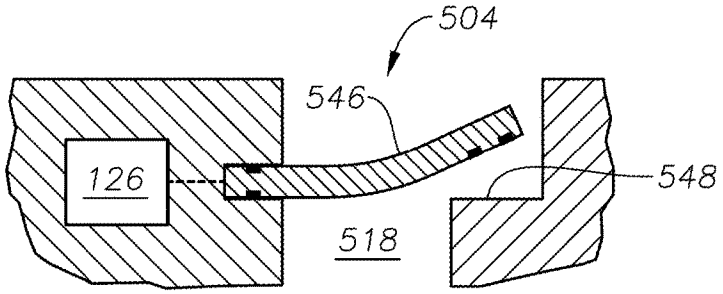
FIGS. 7A and 7B are cross-sectional schematic views of the first piezoelectric valve of FIG. 6 in closed and open configurations respectively.
Figure 7A:
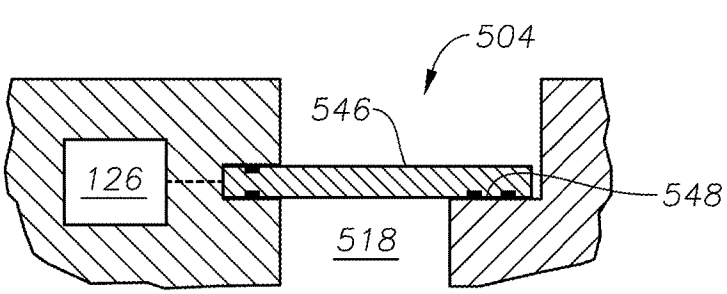

Referring now to FIGS. 7A and 7B, the first valve 504 can comprise a piezoelectric valve having a piezoelectric element 546. The piezoelectric element 546 is operable to generate an internal mechanical strain in response to an applied electrical field, e.g., a drive signal supplied thereto by the controller 126. When no drive signal is applied to the piezoelectric element 546 from the controller 126, the first valve 504 is in a normally-closed configuration (FIG. 7A) wherein the piezoelectric element 546 forms a seal with a valve seat 548. Fluid flow through the entry port 518 is thereby obstructed when the first valve is in the closed configuration. When a drive signal is applied to the piezoelectric element 546 from the controller 126, the first valve 504 moves to an open configuration (FIG. 6B) wherein the piezoelectric element 546 is in a strained or deformed state that separates the piezoelectric element 546 from the valve seat 548. Fluid flow through the entry port 518 is permitted when the first valve 504 is in the open configuration. In some embodiments, the second valve 506 also comprises a piezoelectric valve, and in some embodiments the first and/or second valves 504, 506 can comprise other types of telemetrically activated valves.

Figure 8:
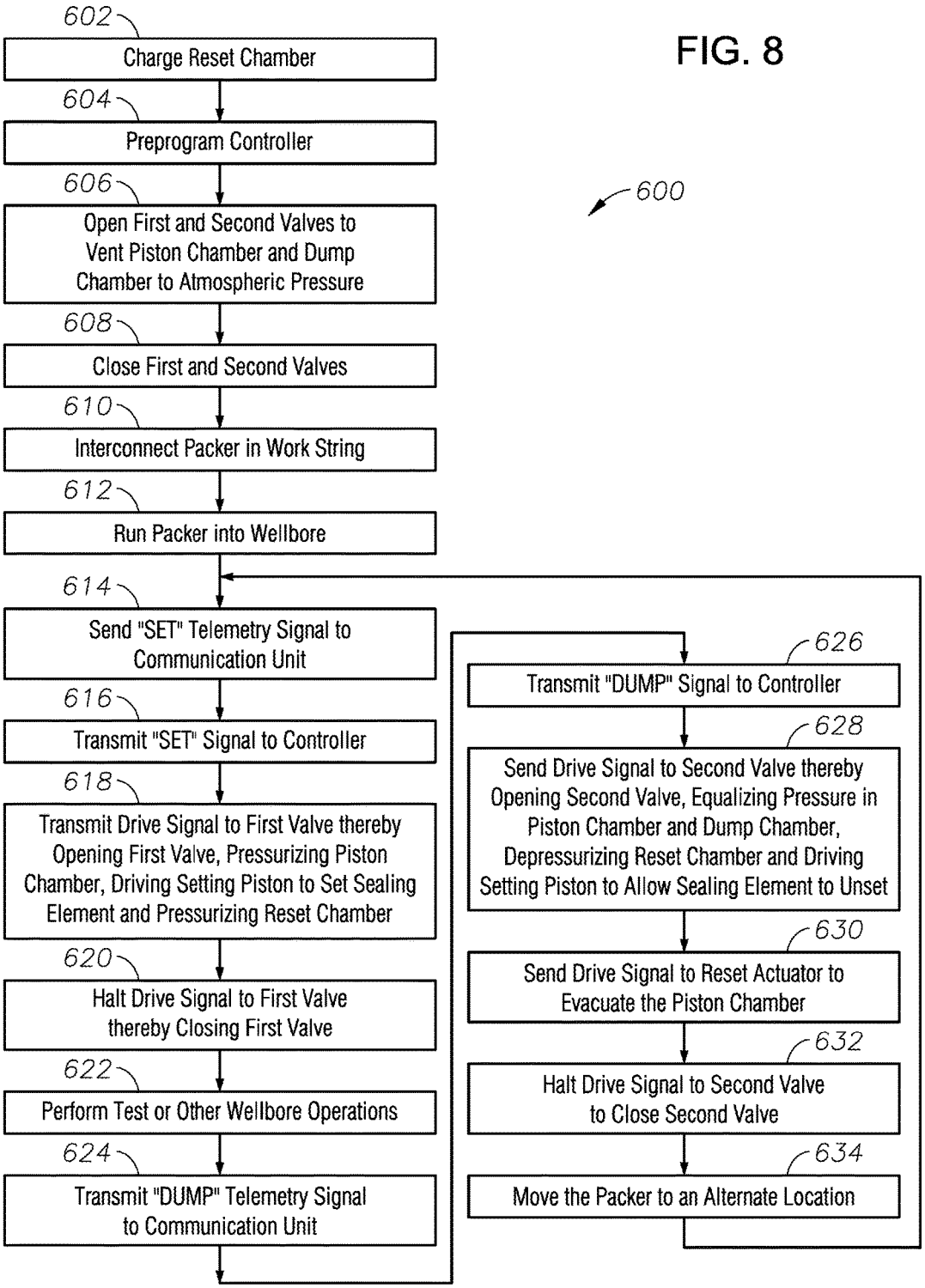
FIG. 8 is a flowchart illustrating a method of operating a packer of FIG. 6 in accordance with example embodiments of the present disclosure.

Referring to FIG. 8, and with continued reference to FIGS. 1 and 6 through 7B, example embodiments of an operational procedure 600 for employing the packer 500 are illustrated. Initially, reset chamber 530 can be charged with a supply of a gaseous fluid such as argon or nitrogen "N" at the surface location "S" (step 602). A sufficient quantity of nitrogen "N" can be supplied to establish a charging pressure within the reset chamber 530 that is greater than an ambient surface pressure, e.g., greater than about 1 atmosphere. The controller 126 can then be pre-programmed at the surface location "S" (step 604) by installing instructions for operating the first and second valves 504, 506 and the reset actuator 536 onto the computer readable medium 126*b*. The first and second valves 504, 506 can be moved to open configurations (step 606) such that the ambient surface pressure, e.g., about 1 atmosphere, is established within the piston chamber 522 and the dump chamber 526. Since the reset chamber 530 is charged to the charging pressure above the ambient surface pressure, the setting piston 508 is urged away from the sealing element 22 (in the direction of arrow $A_8$) by the pressure of the nitrogen "N" in the reset chamber 530. The first and second valves 504, 506 can both be moved to the closed positions (step 608), thereby sealing the ambient surface pressure within the piston chamber 522 and the dump chamber 526.

The packer 500 can be interconnected into the work string 18 (step 610) by threading or coupling the mandrel 512 therein, and then the packer 500 can then be run into the wellbore 12 on the work string 18 (step 612). Once the packer 500 is in position, the exterior environment 520 can be defined by the annulus 26 (or an internal tubing passageway (not shown) defined radially within the mandrel 512). A down-hole annulus pressure can be significantly greater than the surface ambient pressure and the charging pressure. An operator can then send a "SET" telemetry signal from the surface unit 32 to the communication unit 30 (step 614), and the "SET" signal can be transmitted from the communication unit 30 to controller 126 (step 616).

The processor 126*a* of the controller 126 can execute a predetermined sequence of instructions stored on computer readable medium 126*b* to send a drive signal to the first valve 504 (step 618). The drive signal can move the first valve 504 to the open configuration (FIG. 7B) permitting fluid from the external environment 520 to increase the pressure in the piston chamber 522 from the surface ambient pressure to the down-hole annulus pressure. This increase in pressure drives the setting piston 508 in a compression or down-hole direction (in the direction of arrow $A_7$). The compressive or down-hole movement of the setting piston 508 longitudinally compresses the sealing element 22 to radially expand the sealing element 22. The compressive or down-hole movement of the setting piston 508 also reduces the volume of the reset chamber 530, thereby pressurizing the nitrogen "N" or other compressible fluid therein.

The drive signal can be halted (step 620) to return the first valve 504 to the closed configuration (FIG. 7A). With the first valve 504 in the closed configuration, the piston chamber 522 is maintained at the down-hole annulus pressure, and the sealing element 22 is thereby maintained in the set configuration. A wellbore test or other wellbore operations can be performed (step 622) while the sealing element 22 is maintained in the set configuration.

When the wellbore test or other operation is complete, an operator can cause the sealing element 22 can be unset by transmitting an "UNSET" or "DUMP" telemetry signal to the communication unit 30 from the surface unit 32 (step 624). The communication unit 30 can receive the "DUMP" signal and transmit "DUMP" signal to the processor 126*a* of the controller 126 (step 626). In response to receiving the "DUMP" signal, the processor 126*a* can initiate another predetermined sequence of instructions to send a drive signal to the second valve 506 (step 628), to thereby move the second valve to an open configuration.

Opening the second valve 506 equalizes the pressure in the piston chamber 522 and the dump chamber 526. Since the dump chamber 526 is larger than the piston chamber 522, the pressure within the piston chamber 522 is reduced. The pressure in the reset chamber 530 can then drive the setting piston 508 in the retracting or up-hole direction of arrow $A_8$, and the sealing element 22 is permitted longitudinally relax, and radially withdraw toward the mandrel 512.

In some example embodiments, the predetermined sequence of instructions executed by the processor 126*a* in response to receiving the "DUMP" signal can include instructions to send a drive signal to the reset actuator 536 (step 630) to drive the reset piston 534 into the piston chamber, e.g., in the direction of arrow $A_9$. The movement of the reset piston 534 into the piston chamber 522 can drive at least a portion of the remaining fluid from the piston chamber 522 into the exterior environment 520 (through the check valve 540) or into the dump chamber 526 (through the second valve 506). The reset piston evacuates the piston chamber 522, thereby reducing the pressure in the piston chamber 522.

The drive signal supplied to the second valve 506 can then be halted (step 632) to close the second valve 506. The packer 500 can be moved to an alternate location in the wellbore 12 (step 634), and the procedure 600 can return to step 614 to set the sealing element 22 in the alternate location. Alternately, the packer 500 can be withdrawn from the wellbore 12, if the well operations are complete.

In one aspect, the present disclosure is directed to a down-hole well control tool activated ill response to a telemetry signal. The down-hole well control tool includes a mandrel that defines a longitudinal axis and is operable to interconnect the down-hole well control tool within a work string. A housing is coupled to the mandrel, and a setting piston is provided that defines a setting face thereon. The setting piston is responsive to an operating pressure applied to the setting face for longitudinal movement with respect to the mandrel to compress the sealing element. A piston chamber is defined within the housing and encloses the setting face. An entry port extends between the piston chamber and an exterior of the housing. A first valve is disposed within the entry port for selectively permitting and restricting fluid flow therethrough. A communication unit is coupled to the mandrel for receiving a telemetry signal, and a controller is coupled to the communication unit and the first and second valves, the controller operable to control the first valve in response to the telemetry signal.

In some exemplary embodiments, a reset piston is provided within h piston chamber, and is selectively movable therein independently of the setting piston. In some exemplary embodiments, the setting piston is operatively coupled to a reset actuator for moving the reset piston, and the reset actuator can include an electric motor controlled by the controller. In some exemplary embodiments, a check valve is disposed in a passageway extending between the piston chamber and the exterior of the housing, wherein the check valve is operable to prohibit fluid flow into the piston chamber through the passageway from the exterior of the housing.

In some exemplary embodiments, the setting piston defines an unsetting face thereon, wherein the setting piston is responsive to operating pressures applied to the unseating face for longitudinal movement with respect to the mandrel. A reset chamber is defined within the housing that encloses the unsetting face, and the reset chamber is fluidly isolated or sealed within the housing. The reset chamber is charged with a supply of a compressible fluid, and the compressible fluid can be an inert gas such as argon or nitrogen.

In another aspect, the present disclosure is directed to a down-hole packer including a mandrel defining a longitudinal axis and an exterior surface. A sealing element is disposed over a portion of the exterior surface of the mandrel, and the sealing element is responsive to compression to expand radially from the mandrel. The down-hole packer also includes a housing coupled to the mandrel, and a setting piston defining a setting face thereon. The setting piston is responsive to operating pressures applied to the setting face for longitudinal movement with respect to the mandrel in a compression direction, and the setting piston is operably coupled to the sealing element to compress the sealing element. A piston chamber is defined within the housing and encloses the setting face. An entry port extends between the piston chamber and an exterior of the housing, and a first valve is disposed within the entry port for selectively permitting and restricting fluid flow therethrough.

In one or more exemplary embodiments, the down-hole packer further includes a communication unit that is operable to receive telemetry signals and a controller that is operably coupled to the communication unit and responsive to the telemetry signals to control the first valve. The first valve may include a piezoelectric element that is operable to generate an internal mechanical strain in response to an applied electrical field, and the controller may be operable to generate a drive signal to apply the electrical field based on the telemetry signals.

In some exemplary embodiments, the down-hole packer further includes a reset chamber defined within the housing and enclosing an unsetting face defined on the setting piston. The setting piston may be responsive to operating pressures applied to the unsetting face for longitudinal movement with respect to the mandrel in a retracting direction that is opposite the compression direction. In some embodiments, the reset chamber may be fluidly isolated within the housing, and charged with a supply of a compressible fluid.

In one or more exemplary embodiments, the down-hole packer further includes a reset piston disposed within the piston chamber and movable therein to modify a volume of the piston chamber independently of the setting piston. In some embodiments, the down-hole packer further includes a reset actuator operable to move the reset piston, and the reset actuator may be operably coupled to the controller.

In some exemplary embodiments, the down-hole packer further includes a dump chamber defined within the housing and remotely disposed with respect to the setting face. The down-hole packer may also include a pass-through port extending between the piston chamber and the dump chamber and a second valve disposed within the pass-through port.

In another aspect, the present disclosure is directed to a down-hole well control activated in response to a telemetry signal. The down-hole well control tool includes a mandrel defining a longitudinal axis, and the mandrel has fasteners thereon for interconnecting the mandrel within a work string. A housing is coupled to the mandrel, and a setting piston is defined a setting face thereon. The setting piston is responsive to an operating pressure applied to the setting face for longitudinal movement with respect to the mandrel to compress the sealing element. A piston chamber is defined within the housing and encloses the setting face. A dump chamber is defined within the housing and is remotely disposed with respect to the setting face. An entry port extends between the piston chamber and an exterior of the housing. A pass-through port extends between the piston chamber and the dump chamber. First and second valves are disposed within the entry port and the pass-through port respectively for selectively permitting and restricting fluid flow therethrough. A communication unit is coupled to the mandrel for receiving a telemetry signal, and a controller is coupled to the communication unit and the first and second valves. The controller is operable to control the first and second valves in response to the telemetry signal.

In some exemplary embodiments, the down-hole well control tool of claim may further include a sealing element coupled to the mandrel, and the sealing element may be responsive to compression by the setting piston to expand radially with respect to the mandrel. In some exemplary embodiments, the down-hole well control tool further includes reset chamber enclosing an unsetting face defined by the setting piston, and the setting piston may be responsive to an operating pressure applied to the unsetting face for longitudinal movement with respect to the mandrel. The reset chamber may be fluidly isolated within the housing. In some exemplary embodiments, the down-hole well control tool of claim 9, further comprising a reset piston disposed within the piston chamber and movable therein to modify a volume of the piston chamber independently of the setting piston.

In another aspect, the present disclosure is directed to a method of setting a packer in a wellbore. The method includes (a) interconnecting a mandrel into a work string, (b) running the work string into a wellbore to dispose the mandrel at a desired location within the wellbore, (c) sending a SET telemetry signal from a surface location to a communication unit coupled to the mandrel, (d) executing, with a controller coupled to the communication unit and in response to the SET telemetry signal, a predetermined sequence of instructions to cause a first valve to move to an open configuration to thereby permit fluid from an external environment of the housing to flow into a piston chamber defined within the housing and to thereby apply an operating pressure to a setting piston to drive the setting piston in a compression direction to radially expand a sealing element, (e) sending an UNSET telemetry signal from the surface location to the communication unit coupled to the mandrel, and (f) executing, with the controller and in response to the UNSET telemetry signal, a predetermined sequence of instructions to cause a second valve to move to an open configuration to thereby permit fluid from the piston chamber to flow into a dump chamber defined within the housing to equalize a pressure in the piston chamber and the dump chamber and to relieve the operating pressure from the setting piston to permit the setting piston to move in a retracting direction thereby radially withdraw the sealing element.

In some exemplary embodiments, the method further includes, prior to running the work string into the wellbore, opening the first and second valves to vent the piston chamber and the dump chamber to a surface ambient pressure, and closing the first and second valves to maintain the surface ambient pressure within the piston chamber and the dump chamber while the work string is run into the wellbore. The method may further include, prior to running the work string into the wellbore, charging a reset chamber defined within the housing and enclosing an unsetting face thereof with a fluid to a pressure greater than the surface ambient pressure.

In one or more exemplary embodiments, moving the first and second valve to the respective open configurations includes sending a drive signal to a respective piezoelectric element of the first and second valve. The drive signal may generate an internal mechanical strain in the respective piezoelectric elements.

In some exemplary embodiments, the method further includes moving, subsequent to causing the second valve to move to the open configuration, a reset piston within the piston chamber to modify a volume of the piston chamber to evacuate the piston chamber. The method may further include sending, with the communication unit, an error signal to the surface location responsive to detecting an error condition. In one or more exemplary embodiments, the method further includes moving the mandrel to an additional location in the wellbore and repeating steps (c) and (d) to reset the sealing element at the additional location.

Moreover, any of the methods described herein may be embodied within a system including electronic processing circuitry to implement any of the methods, or a in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A down-hole packer adapted to be interconnected in a work string that is positioned in a wellbore, the down-hole packer comprising:

a mandrel defining a longitudinal axis and an exterior surface;

a sealing element disposed over a portion of the exterior surface of the mandrel, the sealing element responsive to compression to expand radially from the mandrel;

a housing coupled to the mandrel;

a setting piston defining a setting face and an unsetting face thereon, the setting piston responsive to operating pressures applied to the setting face for longitudinal movement with respect to the mandrel in a compression direction, the setting piston operably coupled to the sealing element to compress the sealing element, and the setting piston responsive to operating pressures applied to the unsetting face for longitudinal movement with respect to the mandrel in a retracting direction that is opposite the compression direction;

a piston chamber defined within the housing and enclosing the setting face;

a dump chamber defined within the housing and remotely disposed with respect to the setting face, the dump chamber being configured to be in fluid communication with the piston chamber;

an entry port extending between the piston chamber and an exterior of the housing, wherein the entry port is in fluid communication with an annulus defined by the work string and the wellbore; and a reset chamber defined within the housing and enclosing the unseating face defined on the setting piston, wherein the reset chamber is fluidly isolated from both the piston chamber and the dump chamber within the housing.

2. The down-hole packer of claim 1, wherein the reset chamber is charged with a supply of a compressible fluid.

3. The down-hole packer of claim 1, further comprising:

a first valve disposed within the entry port for selectively permitting and restricting fluid flow therethrough;

a pass-through port extending between the piston chamber and the dump chamber; and a second valve disposed within the pass-through port for selectively permitting and restricting fluid flow therethrough.

4. The down-hole packer of claim 3, further comprising a communication unit operable to receive telemetry signals and a controller operably coupled to the communication unit and responsive to the telemetry signals to control the first valve.

5. The down-hole packer of claim 4, wherein the first valve includes a piezoelectric element that is operable to generate an internal mechanical strain in response to an electrical field applied to the piezoelectric element, and wherein the controller is operable to generate a drive signal to apply the electrical field based on the telemetry signals.

6. The down-hole packer of claim 1, wherein the mandrel and the housing are separately formed.

7. The down-hole packer of claim 1, wherein the down-hole packer is actuable between:

a first configuration in which fluid is permitted to flow through the entry port from the annulus defined by the work string and the wellbore into the piston chamber to thereby apply the operating pressure to the setting piston to drive the setting piston in the compression direction to radially expand the sealing element; and a second configuration in which fluid is permitted to flow from the piston chamber into the dump chamber to equalize a pressure in the piston chamber and the dump chamber and to relieve the operating pressure from the setting piston to permit the setting piston to move in the retracting direction to radially withdraw the sealing element.

8. The down-hole packer of claim 7, wherein, in the first configuration of the down-hole packer, fluid flow from the piston chamber into the dump chamber is restricted; and wherein, in the second configuration of the down-hole packer, fluid flow through the entry port is restricted.

9. A down-hole packer, comprising:

a mandrel defining a longitudinal axis and an exterior surface;

a sealing element disposed over a portion of the exterior surface of the mandrel, the sealing element responsive to compression to expand radially from the mandrel;

a housing coupled to the mandrel;

a setting piston defining a setting face thereon, the setting piston responsive to operating pressures applied to the setting face for longitudinal movement with respect to the mandrel in a compression direction, and the setting piston operably coupled to the sealing element to compress the sealing element;

a piston chamber defined within the housing and enclosing the setting face;

an entry port extending between the piston chamber and an exterior of the housing;

a first valve disposed within the entry port for selectively permitting and restricting fluid flow therethrough; and a reset piston disposed within the piston chamber and movable therein to modify a volume of the piston chamber independently of the setting piston.

10. The down-hole packer of claim 9, further comprising a reset actuator operable to move the reset piston, and wherein the reset actuator is operably coupled to a controller.

11. A down-hole well control tool adapted to be activated in response to a telemetry signal, the down-hole well control tool comprising:

a mandrel defining a longitudinal axis, the mandrel having fasteners thereon for interconnecting the mandrel within a work string;

a housing coupled to the mandrel;

a setting piston defining a setting face and an unsetting face thereon, the setting piston responsive to an operating pressure applied to the setting face for longitudinal movement with respect to the mandrel to compress a sealing element, and the setting piston responsive to an operating pressure applied to the unsetting face for longitudinal movement with respect to the mandrel to decompress the sealing element;

a piston chamber defined within the housing and enclosing the setting face;

a dump chamber defined within the housing and remotely disposed with respect to the setting face;

an entry port extending between the piston chamber and an exterior of the housing, wherein the entry port is in fluid communication with an annulus defined by the work string and a wellbore;

a pass-through port extending between the piston chamber and the dump chamber;

first and second valves disposed within the entry port and the pass-through port respectively for selectively permitting and restricting fluid flow therethrough;

a reset chamber enclosing the unsetting face defined by the setting piston, wherein the reset chamber is fluidly isolated from both the piston chamber and the dump chamber within the housing;

a communication unit coupled to the mandrel for receiving a telemetry signal; and a controller coupled to the communication unit and the first and second valves, the controller operable to control the first and second valves in response to the telemetry signal.

12. The down-hole well control tool of claim 11, wherein the sealing element is coupled to the mandrel, and wherein the sealing element is responsive to compression by the setting piston to expand radially with respect to the mandrel.

13. The down-hole well control tool of claim 11, further comprising a reset piston disposed within the piston chamber and movable therein to modify a volume of the piston chamber independently of the setting piston.

14. The down-hole well control tool of claim 11, wherein the mandrel and the housing are separately formed.

15. The down-hole well control tool of claim 11, wherein the down-hole well control tool is actuable between:

a first configuration in which the first valve is open to permit fluid to flow through the entry port from the annulus defined by the work string and the wellbore into the piston chamber to thereby apply an operating pressure to the setting piston to drive the setting piston to radially expand the sealing element; and a second configuration in which the second valve is open to permit fluid to flow through the pass-through port from the piston chamber into the dump chamber to equalize a pressure in the piston chamber and the dump chamber and to relieve the operating pressure from the setting piston to permit the setting piston to radially withdraw the sealing element.

16. The down-hole well control tool of claim 15, wherein, in the first configuration of the down-hole well control tool, the second valve is closed to restrict fluid flow through the pass-through port; and wherein, in the second configuration of the down-hole well control tool, the first valve is closed to restrict fluid flow through the entry port.

17. A method of setting a packer in a wellbore, the method comprising:

(a) interconnecting a mandrel into a work string;

(b) running the work string into a wellbore to dispose the mandrel at a desired location within the wellbore;

(c) sending a SET telemetry signal from a surface location to a communication unit coupled to the mandrel;

(d) executing, with a controller coupled to the communication unit and in response to the SET telemetry signal, a predetermined sequence of instructions to cause a first valve, which is disposed in an entry port that extends between a piston chamber and an exterior of a housing that is coupled to the mandrel, to move to an open configuration to thereby permit fluid from an annulus defined by the work string and the wellbore to flow into the piston chamber that is defined within the housing and to thereby apply an operating pressure to a setting piston to drive the setting piston in a compression direction to radially expand a sealing element, the piston chamber enclosing a setting face of the setting piston;

(e) sending an UNSET telemetry signal from the surface location to the communication unit coupled to the mandrel; and (f) executing, with the controller and in response to the UNSET telemetry signal, a predetermined sequence of instructions to cause a second valve to move to an open configuration to thereby permit fluid from the piston chamber to flow into a dump chamber defined within the housing to equalize a pressure in the piston chamber and the dump chamber and to relieve the operating pressure from the setting face of the setting piston to permit the setting piston to move in a retracting direction that is opposite the compression direction to radially withdraw the sealing element; and (g) charging a reset chamber defined within the housing with a fluid configured to drive the setting piston in the retracting direction when the operating pressure is relieved from the setting face of the setting piston, the reset chamber enclosing an unsetting face defined by the setting piston and being fluidly isolated from both the piston chamber and the dump chamber within the housing.

18. The method of claim 17, further comprising, prior to running the work string into the wellbore:

opening the first and second valves to vent the piston chamber and the dump chamber to a surface ambient pressure; and closing the first and second valves to maintain the surface ambient pressure within the piston chamber and the dump chamber while the work string is run into the wellbore.

19. The method of claim 18, wherein, prior to running the work string into the wellbore, the reset chamber is charged with the fluid to a pressure greater than the surface ambient pressure.

20. The method of claim 17, wherein moving the first and second valve to the respective open configurations comprises sending a drive signal to a respective piezoelectric element of the first and second valve to generate an internal mechanical strain in the respective piezoelectric elements.

21. The method of claim 17, further comprising moving, subsequent to causing the second valve to move to the open configuration, a reset piston within the piston chamber to modify a volume of the piston chamber to evacuate the piston chamber.

22. The method of claim 17, further comprising sending, with the communication unit, an error signal to the surface location responsive to detecting an error condition.

23. The method of claim 17, further comprising moving the mandrel to an additional location in the wellbore and repeating steps (c) and (d) to reset the sealing element at the additional location.

* * * * *